US005806015A

United States Patent [19]

Kimoto

[11] Patent Number: 5,806,015

[45] Date of Patent: Sep. 8, 1998

[54] AUTOMOTIVE CONTROLLER

[75] Inventor: Yasuhiro Kimoto, Hyogo, Japan

[73] Assignee: Mitsubishi Denki Kabushiki Kaisha, Tokyo, Japan

[21] Appl. No.: 967,892

[22] Filed: Nov. 12, 1997

[30] Foreign Application Priority Data

Jul. 22, 1997 [JP] Japan ..... 9-195978

[51] Int. Cl.[6] ..... F02O 41/00

[52] U.S. Cl. ..... 701/115

[58] Field of Search ..... 701/115; 123/417; 364/431.12

[56] References Cited

U.S. PATENT DOCUMENTS

| | | | |
|---|---|---|---|
| 5,331,560 | 7/1994 | Tamura | 364/431.12 |
| 5,531,200 | 7/1996 | Hosoe et al. | 123/417 |
| 5,602,738 | 2/1997 | Sasaki | 701/115 |
| 5,710,703 | 1/1998 | Kirn et al. | 701/115 |

FOREIGN PATENT DOCUMENTS

| | | | |
|---|---|---|---|
| 62-279151 | 12/1987 | Japan | 701/115 |

*Primary Examiner*—Raymond A. Nelli

*Attorney, Agent, or Firm*—Sughrue, Mion, Zinn, Macpeak & Seas, PLLC

[57] ABSTRACT

An automotive controller permits easy reading of a program identification code in a ROM without the need for using any special readout device. The automotive controller is equipped with: a processing unit (10) which has various sensors **(3*a*, 5 through 7, 31) for supplying various types of data indicative of the operational state of a motorcar, a RAM (103), and a ROM (102), and which performs arithmetic processing on the data; and output devices (4, 11) driven according to the operation results given by the processing unit. Stored in advance in the ROM are the set values matched to predetermined conditions of the operational states, and program identification codes keyed to the contents of programs. The output devices include an output unit (111)** for displaying the program identification codes. The processing unit enables the program identification codes in the ROM to be displayed on the output device only when the data indicating the operation states agrees with the present values.

5 Claims, 4 Drawing Sheets

WHEN PROGRAM IDENTIFICATION CODE IS " A "

WHEN PROGRAM IDENTIFICATION CODE IS " B "

AUTOMOTIVE CONTROLLER

BACKGROUND OF THE INVENTION

1. Field of the Invention

The present invention relates to an automotive controller equipped, for example, with an electrically writable ROM and, more particularly, to an automotive controller which permits easy reading of a program identification code indicative of the contents of a program stored in the ROM without using any special tool such as a readout device.

2. Description of Related Art

There has conventionally been known an automotive controller for performing arithmetic operation for controlling various types of parameters including engine control parameters according to a program stored in a ROM.

FIG. 4 is a flowchart illustrating an example of the control operation performed by a conventional automotive controller which is not shown. The flowchart shows a control program for an engine alarm lamp which has been written to the ROM in advance in an automotive controller, namely, an engine controller, which is provided, for example, with various sensors for detecting the operational state and an engine alarm lamp for displaying an alarm.

In FIG. 4, it is first determined whether a predetermined time has passed since the power was turned ON by a timer which is actuated the moment a key switch is turned ON, thereby checking the engine alarm lamp itself for disconnection (step S1).

If the predetermined time has not yet elapsed after the power was turned ON, i.e. if the determination result is NO, then the system immediately proceeds to step S4 wherein it turns ON the engine alarm lamp regardless of whether there is a faulty sensor or not, and terminates the processing routine of FIG. 4.

If the system decides in step S1 that the predetermined time has passed since the power was turned ON, i.e. if the determination result is YES, then it determines in step S2 whether there is any faulty sensor by referring to a determination result flag indicating the presence of a faulty sensor which has been detected by a different processing routine (not shown).

If it has been decided that there is a faulty sensor, i.e. if the determination result is YES, then the system turns the engine alarm lamp ON in step S4, or if it has been decided that there is no faulty sensor, i.e. if the determination result is NO, then the system turns the engine alarm lamp OFF in step S3, and terminates the processing routine of FIG. 4.

In this type of automotive controller, to update a program in, for example, an electrically rewritable ROM, or to replace the ROM with another one wherein a different program has been stored, it is necessary for a dealer to refer to a program identification code, which indicates the update record or the like of the contents of the program, in the current ROM.

For instance, in the automotive controller which has been referred to in Japanese Examined Patent Publication No. 6-67709, a program identification code for identifying a control program is stored in a ROM beforehand, and the program identification code is output to or displayed on an external device only when a request for outputting the program identification code has been received through communication from the external device.

In other words, in the conventional device employing the electrically writable ROM, the dealer uses a special tool, namely, a writing device, to issue the request for outputting the program identification code in order to prevent erroneous reprogramming. The program identification code thus output is referred to in order to decide whether the program may be rewritten.

If it has been determined that the program may be rewritten after referring to the program identification code, then the system carries out the processing for creating a new program identification code and rewriting the program.

If it has been decided that the program should not be rewritten or that the program has already been rewritten as a result of referring to the program identification code or a version number, then the rewriting is prevented from being implemented.

Thus, in the conventional controller, the program identification code which is required to update the contents stored in the ROM and which is written to the ROM beforehand cannot be known unless the controller is connected to a writing device in advance.

Hence, when carrying out writing operation in a plurality of controllers at a time, it has been necessary to prepare a writing device and a readout device for reading program identification codes for writing and also for verifying whether writing has been completed in each controller.

Further, in the case of a device equipped with a rewriting means for rewriting the contents in a ROM mounted on the board according to a rewrite command received from an external rewriting device, it is very likely that a dealer or the like rewrites the contents in the ROM at a site and the dealer has to decide whether the contents in the ROM may be rewritten. For this reason, it has been required to provide every dealer with a rewriting device.

As described above, in the conventional automotive controller, the writing device must be connected in order to find a program identification code in the ROM, posing a problem in that carrying out the writing operation on a plurality of control devices requires a plurality of writing devices and readout devices be prepared, requiring much cost and labor.

There has been another problem in that, when rewriting the contents of the ROM in response to a rewrite command from an external rewriting device, with the ROM mounted on the board, every dealer has to be supplied with a rewriting device since the dealer must decide whether the contents of the ROM may be rewritten, thus requiring must cost and labor.

SUMMARY OF THE INVENTION

The present invention has been made with a view toward solving the problems described above, and it is an object thereof to provide an automotive controller which permits easy reading of a program identification code in a ROM without the need for using any special tool such as a readout device.

To this end, according to the present invention, there is provided an automotive controller equipped with: various sensors for acquiring data indicative of the operational state of a motorcar; a processing unit which has a RAM for storing data and a ROM for storing a program, and which performs arithmetic operation on data according to the program in the ROM; and various types of output devices driven according to the operation results given by the processing unit; wherein a set value for a predetermined condition of the operational state and a program identification code keyed to the contents of a program are stored in the ROM beforehand, the various output devices include an output device for displaying the program identification code, and the processing unit enables the program identification code in the ROM to be displayed on the output device when the data indicative of the operational state coincides with the set value.

With this arrangement, a program identification code written to a ROM can be displayed without using a special readout device, so that whether the contents in the ROM may be rewritten can be easily determined at a site, permitting improved operability.

In a preferred form of the present invention, the processing unit of the automotive controller is equipped with determining means for determining whether a program identification code may be displayed on an output device, and the determining means decides that the program identification code may be displayed when a combination of a plurality of pieces of data supplied to the processing unit satisfies a predetermined condition of an operational state.

In another preferred form of the present invention, an output device connected to the processing unit of the automotive controller is constituted by a lamp or the like mounted in the vicinity of a driver's seat of the motorcar.

In a further preferred form of the present invention, the output device connected to the processing unit of the automotive controller is driven by a pattern formed by a different number of pulses for each fixed cycle according as the program identification code differs, and the fixed cycle is set to a time which is sufficiently long for the number of pulses to be recognized.

In yet another preferred form of the present invention, the automotive controller is provided with an external rewriting device which is selectively connected to or disconnected from the processing unit and which generates a rewrite command for rewriting a program in the ROM; the processing unit includes writing means for rewriting the program in the ROM in response to the rewrite command; and the ROM is composed of a nonvolatile memory which enables stored contents to be electrically rewritten.

DESCRIPTION OF THE PREFERRED EMBODIMENTS

First Embodiment

A first embodiment of the present invention will be described in conjunction with the accompanying drawings.

Figure 1:
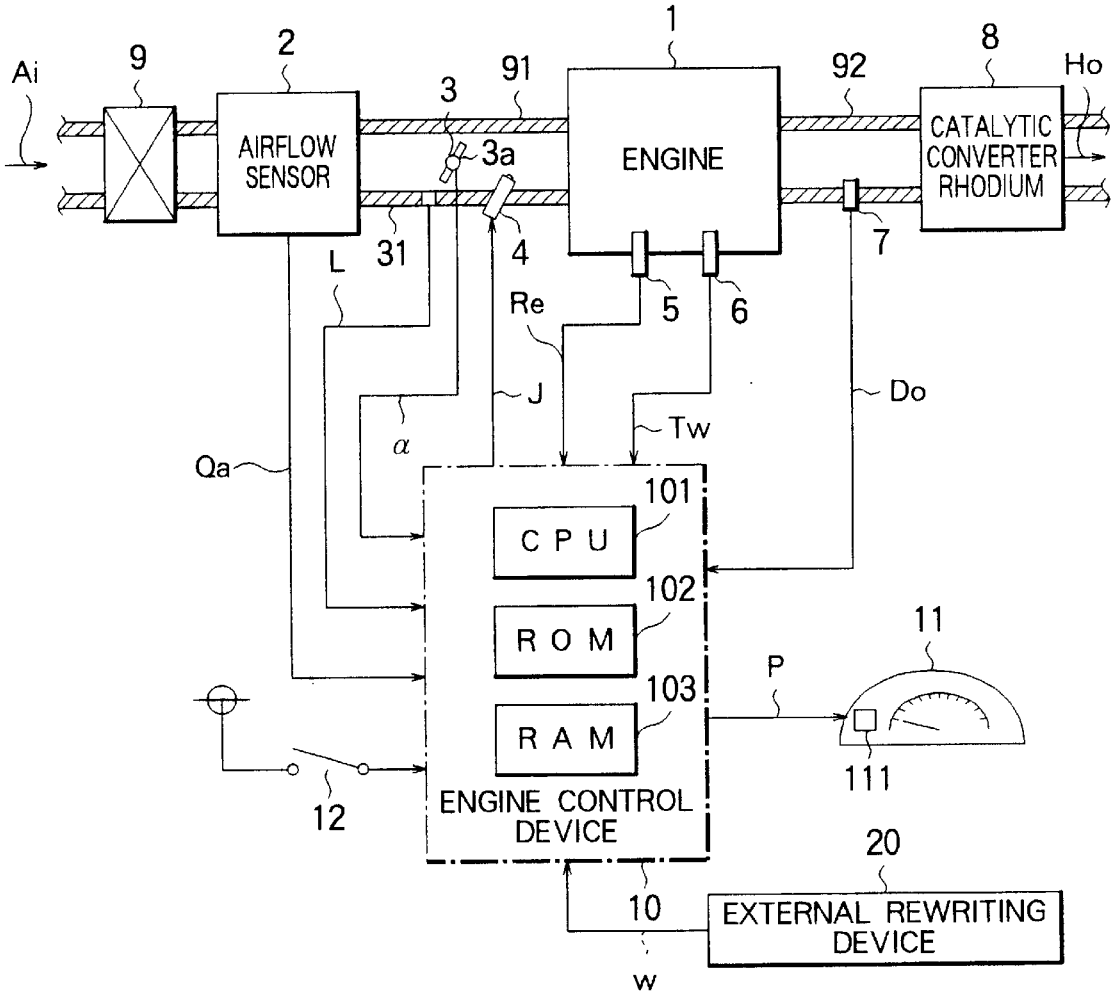
FIG. 1 is a block diagram schematically showing a first embodiment of the present invention.

FIG. 1 is a block diagram schematically showing the entire configuration of the first embodiment of the invention; it shows an engine controller as in the case described previously.

An engine controller 10 shown in FIG. 1 shares the same construction as the conventional device except that the processing means including a control program is partly different.

Connected to an engine 1 are an inlet pipe 91 and an exhaust pipe 92. Air Ai and fuel are drawn in through the inlet pipe 91, while exhaust gas Ho produced by combustion is discharged through the exhaust pipe 92.

The engine 1 is provided with a crank angle sensor 5 which is mounted on the crankshaft, not shown, of the engine 1 and which measures engine speed Re, and a water temperature sensor 6 which measures cooling water temperature Tw of the engine 1.

The inlet pipe 91 is provided with an air cleaner 9 for purifying the inlet air Ai from the atmospheric air, an airflow sensor 2 for detecting the amount of inlet air, or intake air, Qa which has passed through the inlet pipe 91, a throttle valve 3 which interlocks with an accelerator lever, not shown, to regulate the inlet air amount Qa, and an injector 4 which injects fuel at the downstream of the throttle valve 3.

The throttle valve 3 is equipped with a throttle lift sensor 3*a* for detecting throttle lift $\alpha$ of the throttle valve 3, and an idle switch 31 for issuing an idle signal L indicating the fully closed state, i.e. idle state, of the throttle valve 3.

The exhaust pipe 92 is equipped with an oxygen concentration sensor 7 for measuring the concentration Do of oxygen ($O_2$) in the exhaust gas Ho, and a catalytic converter rhodium 8 which is disposed on the downstream side from the oxygen concentration sensor 7 to decompose harmful components in the exhaust gas Ho.

The engine controller 10 composed primarily of a microcomputer receives, as the data or sensor signals indicative of the operational state of the motorcar, the inlet air amount Qa from the airflow sensor 2, the throttle lift $\alpha$ from the throttle lift sensor 3*a,* the idle signal L from the idle switch 31, the engine speed Re from the crank angle sensor 5, the cooling water temperature Tw from the water temperature sensor 6, and the oxygen concentration Do from the oxygen concentration sensor 7.

Connected to the engine controller 10 are the injector 4, a spark plug (not shown), a display panel 11, etc. as diverse output devices involved in the engine control. The display panel 11 functions as an output device for displaying program identification codes.

The display panel 11 is located near the driver's seat and it includes an engine alarm lamp 111 which is driven by a lamp driving signal P issued from the engine controller 10.

A key switch 12 operated by a driver is closed at the time of starting up the engine 1; it supplies battery power to the engine controller 10.

The engine controller 10 is equipped with a CPU 101 which provides the main body of the microcomputer and a ROM 102 and a RAM 103 used for the operation performed by the CPU 101. The engine controller 10 issues a fuel injection signal J to the injector 4, a lamp driving signal P to the engine alarm lamp 111, and other signals according to operation results.

Stored beforehand in the ROM 102 are the programs used for the control operation of the CPU 101, and stored in the RAM 103 are various types of data being processed by the CPU 101. Thus, the CPU 101 executes diverse types of arithmetic processing by using the RAM 103 according to the control programs written to the ROM 102.

The CPU 101 in the engine controller 10 constitutes the processing unit for carrying out arithmetic processing on input data in cooperation with the ROM 102 and the RAM 103. The output devices including the injector 4 and the display panel 11 are connected to the engine controller 10 functioning as the processing unit; they are driven according to the operation results given by the processing unit.

Stored beforehand in the ROM 102 are set values for predetermined conditions of operational state and program identification codes matched to the contents of the programs.

The processing unit in the engine controller 10 renders a program identification code in the ROM 102 displayable on the display panel 11, which is an output device, when data, namely, sensor signals, indicating an operational state matches the set values stored in the ROM 102.

More specifically, the processing unit includes a determining means for determining whether a program identification code may be displayed on the display panel 11, the output device. The determining means decides that the program identification code may be displayed when a combination of a plurality of types of data, sensor signals, supplied to the processing unit satisfies a predetermined condition of the operational state, that is, when the combination agrees with a set value.

In the display panel 11, the output devices for displaying program identification codes are composed of lamps or the like which can be easily recognized. The ROM 102 in the engine controller 10 is constructed by a nonvolatile memory which permits its contents to be electrically rewritable.

An external rewriting device 20 detachably mounted on the engine control device 10, which is the processing unit, is selectively connected to the engine controller 10 when rewriting a program stored in the ROM 102. The external rewriting device 20 is operated by a dealer.

The external rewriting device 20 generates a rewrite command W for rewriting a program stored in the ROM 102. The engine controller 10 is provided with a rewriting means for rewriting a program stored in the ROM 102 in response to the rewrite command W.

The processing unit of the engine control device 10 determines the operational state of the engine 1 according to the diverse sensor signals, Qa, $\alpha$, L, Re, Tw, and Do, and it computes control parameters best suited to the operational state. This permits optimum control of, for example, the driving time of the injector 4 by the fuel injection signal J received from the processing unit, so that the amount of fuel matched to the operational state is supplied to the engine 1.

The engine controller 10 also checks the various sensors 2, 3*a*, 31, 5, 6, and 7 used in engine control for failures, and if any failure is detected, then it stores the failure in the RAM 103 and causes the engine alarm lamp 111 in the display panel 11 to come ON by the lamp driving signal P to inform the driver of the occurrence of the failure.

The operation of the first embodiment of the present invention shown in FIG. 1 will now be described with reference to the flowchart given in FIG. 2.

Figure 2:
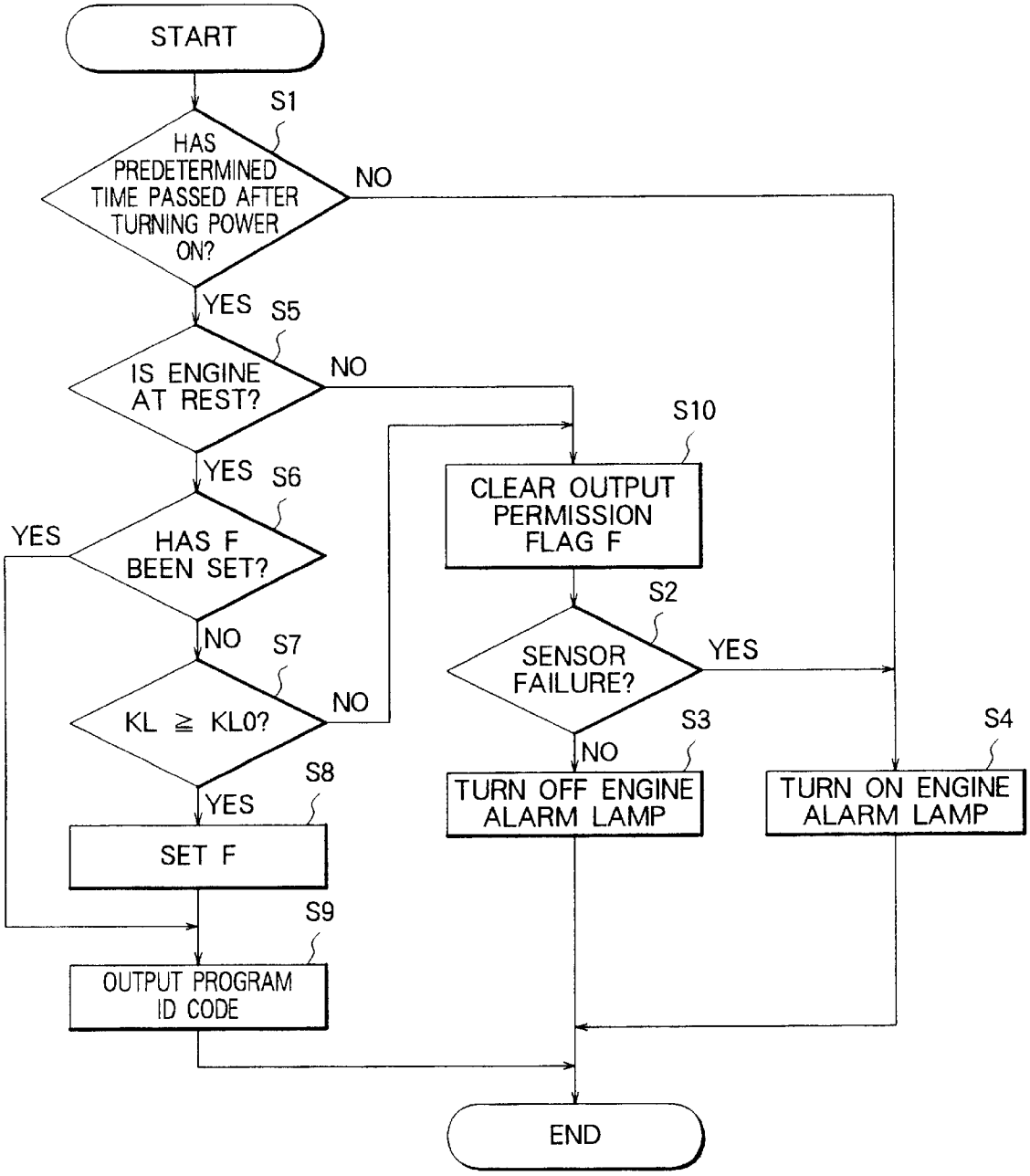
FIG. 2 is a flowchart illustrating an example of the control operation performed by the first embodiment of the present invention.
Figure 4:
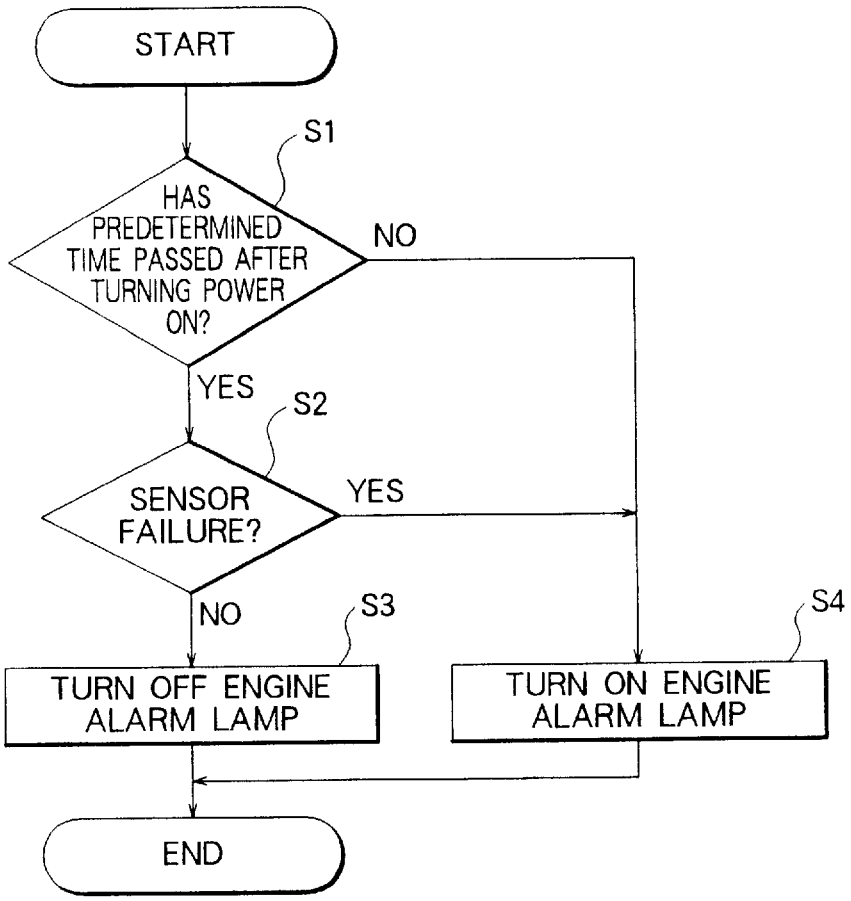
FIG. 4 is a flowchart illustrating an example of the control operation performed by a conventional automotive controller.

FIG. 2 shows the processing routine related to the permission of the output of a program identification code implemented by the determining means in the engine controller 10. Steps S1 through S4 are the same as those shown in FIG. 4.

In FIG. 2, steps S5 through S10 are added between step S1 and step S2.

In this embodiment, it is assumed that the number KL of ON's and OFF's of the idle signal L received from the idle switch 31 within a predetermined time which will be used as the predetermined condition of the operational state for determining whether a program identification code may be output or not, and a predetermined number KLo which is not observed in normal operation and which is used as the set value for the predetermined condition have been stored in advance.

First, if it is determined in step S1 that a predetermined time has passed since the power was turned ON, i.e. if the determination result is YES, then the processing unit determines in step S5 whether the engine 1 is at rest by referring, for example, to the engine speed Re.

If the processing unit decides that the engine 1 is not at rest, i.e. if the determination result is NO, then it proceeds to step S10 wherein it clears a flag F for permitting the output of a program identification code, then it goes back to step S2 to implement the processing of step S2 and after.

If the processing unit determines in step S5 that the engine 1 is at rest, i.e. if the determination result is YES, then it further determines in step S6 whether the flag F for permitting the output of a program identification code has been set.

If the processing unit determines that the output permission flag F has already been set, i.e. if the determination result is YES, then it proceeds to step S9 wherein it outputs the program identification code, and terminates the processing routine of FIG. 2.

If the processing unit decides in step S6 that the output permission flag F has not yet been set, i.e. if the determination result is NO, then it further determines in step S7 whether the number KL of the ON's and OFF's of the idle signal L in the predetermined time is the predetermined number KLo or more.

The number KL of ON's and OFF's of the idle signal L within the predetermined time is counted in a different routine (not shown).

If the processing unit decides in step S7 that $KL \geqq KLo$, i.e. if the determination result is YES, then it sets the output permission flag F for the program identification code, and proceeds to step S9 wherein it outputs the program identification code.

If the processing unit decides in step S7 that $KL < KLo$, i.e. if the determination result is NO, then it clears the output permission flag F for the program identification code in step S10, and proceeds to step S2.

Thus, owing to the added processing steps S5 through S10, the output permission flag F is set only when the predetermined operating condition is satisfied, that is, only when a dealer forcibly operates the controller, the output permission flag F is set to enable the output of a program identification code.

Hence, program identification codes are not displayed during normal operation, preventing an inconvenience that confuses a driver.

Figure 3A:
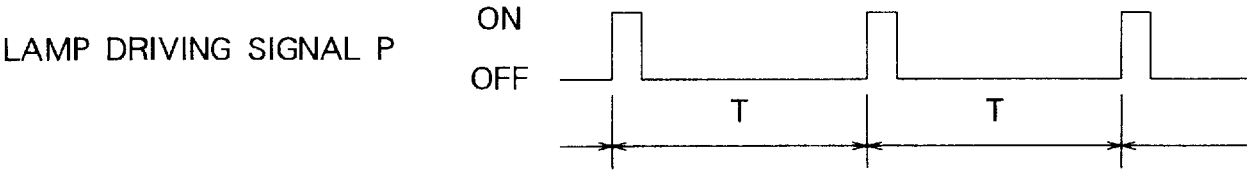
FIGS. 3A and 3B are timing charts illustrating the output patterns of a program identification code in the first embodiment of the present invention.
Figure 3B:
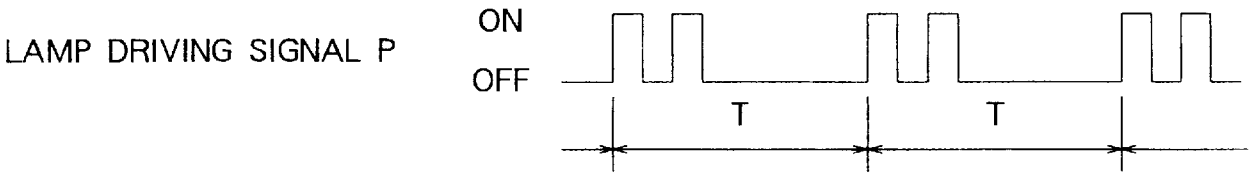

FIGS. 3A and 3B are timing charts illustrating the patterns of the program identification codes of the lamp driving signal P for the engine alarm lamp 111 which is output in step S9 shown in FIG. 2. FIG. 3A shows the pulse waveform of the lamp driving signal P when the program identification code is A; and FIG. 3B shows the pulse waveform of the lamp driving signal P when the program identification code is B.

The lamp driving signal P is formed in patterns according to the number of pulses generated at every fixed cycle T; the number of pulses for the program identification code A shown in FIG. 3A has been set to 1, while the number of pulses for the program identification code B shown in FIG. 3B has been set to 2.

Accordingly, the number of the ON's and OFF's of the engine alarm lamp 111 at every fixed cycle T is 1 when the program identification code is A, and it is 2 when the program identification code is B.

The fixed cycle T is set to a time, e.g. about 1 second, which is long enough for the dealer to recognize the number of pulses.

Thus, the dealer can refer to the ON/OFF display of the engine alarm lamp 111, recognize the contents of the control program for the engine alarm lamp 111 in the engine controller 10, and determines whether the control program may be rewritten before operating the external rewriting device 20 connected to the engine controller 10.

The use of the engine alarm lamp 111 which is composed of an ordinary display lamp prevents increased cost and also permits easy recognition of the program identification codes.

Especially when rewriting the contents of the rewritable ROM 102 by using the external rewriting device 20 as shown in FIG. 1, the rewrite processing involved in determining whether writing is allowed can be implemented easily since the program identification codes can be easily referred to without the need for any special readout device.

Second Embodiment

In the first embodiment described above, whether the number KL of ON's and OFF's of the idle switch 31 is the predetermined number KLo or more is determined in step S7 as the predetermined operating condition for deciding whether a program identification code may be output, and if it satisfies the operating condition of step S7, i.e. if the output permission flag F is set, then the program identification code is immediately displayed. Alternatively, however, a plurality of arbitrary input data may be combined for the operating condition.

For instance, to count the number KL of ON's and OFF's of the idle switch 31, counting the number of OFF's only when the throttle lift $\alpha$ observed when the idle signal L is OFF, that is, when the throttle valve 3 is not fully closed, is a predetermined lift or more prevents malfunction attributable to the chattering, i.e. below the predetermined lift, of the idle switch 31.

Third Embodiment

In the first embodiment above, the engine alarm lamp 111 mounted on the display panel 11 has been used as the output device for displaying the program identification codes; however, any other output device may be used as long as it is capable of recognizing the program identification codes.

Further, the lamp driving signal P of the engine alarm lamp 111 indicating the failure of a sensor has been used as a control parameter of a motorcar; however, any other control parameter related to automotive control may be used.

Although the engine controller has been used as the automotive controller, it is obvious that the same operations and advantages will be obtained even when the present invention is applied to any other types of controllers such as a speed change controller.

What is claimed is:

1. An automotive controller comprising:

various sensors for acquiring data indicative of the operational state of a motorcar;

a processing unit which has a RAM for storing data and a ROM for storing a program, and which performs arithmetic processing on said data according to the program in said ROM; and various types of output devices driven according to the arithmetic processing results given by said processing unit;

wherein a set value corresponding to a predetermined condition of said operational state and a program identification code keyed to the contents of said program are stored in said ROM beforehand, said various output devices include an output device for displaying said program identification code, and said processing unit enables the program identification code in said ROM to be displayed on said output device when the data indicative of said operational state coincides with said set value.

2. An automotive controller according to claim 1, wherein said processing unit is equipped with determining means for determining whether said program identification code may be displayed on said output device, and said determining means decides that said program identification code may be displayed when a combination of a plurality of pieces of data supplied to said processing unit satisfies the predetermined condition of said operational state.

3. An automotive controller according to claim 1, wherein an output device connected to said processing unit is constituted by a lamp or the like mounted in the vicinity of a driver's seat of said motorcar.

4. An automotive controller according to claim 3, wherein the output device connected to said processing unit is driven by a pattern formed by a different number of pulses for each fixed cycle according as said program identification code differs, and said fixed cycle is set to a time which is sufficiently long for said number of pulses to be recognized.

5. An automotive controller according to claim 1, further comprising an external rewriting device which is selectively connected to or disconnected from said processing unit and which generates a rewrite command for rewriting a program in said ROM; wherein said processing unit includes writing means for rewriting the program in said ROM in response to said rewrite command; and said ROM is composed of a nonvolatile memory which enables stored contents to be electrically rewritten.

* * * * *